United States Patent [19]

Barlebo et al.

[11] Patent Number: 4,642,905

[45] Date of Patent: Feb. 17, 1987

[54] HEAT EXCHANGER

[75] Inventors: Lars M. Barlebo; Joachim Nickelsen, both of Copenhagen, Denmark

[73] Assignee: F. L. Smidth & Co. A/S, Denmark

[21] Appl. No.: 718,898

[22] Filed: Apr. 2, 1985

[30] Foreign Application Priority Data

Apr. 10, 1984 [GB] United Kingdom ..... 8409202

[51] Int. Cl.[4] ..... F26B 3/10

[52] U.S. Cl. ..... 34/10; 34/57 E

[58] Field of Search ..... 34/10, 57 R, 57 E

[56] References Cited

U.S. PATENT DOCUMENTS

| | | | |
|---|---|---|---|
| 3,127,250 | 3/1964 | Heinemann | 34/57 E |
| 3,305,940 | 2/1967 | Isler | 34/57 E |
| 4,378,234 | 3/1983 | Suzuki et al. | 34/57 E |

*Primary Examiner*—Larry I. Schwartz

*Attorney, Agent, or Firm*—Brumbaugh, Graves, Donohue & Raymond

[57] ABSTRACT

A heat exchanger has a cylindrical chamber (6) with a tangential peripheral gas inlet (1), an axial gas outlet (2), a material inlet (3) which introduces the material with a tangential velocity components in the same sense as that of the spiral gas flow at the point of introduction, and a material outlet (5).

6 Claims, 3 Drawing Figures

HEAT EXCHANGER

The invention relates to a heat exchanger of the kind used for obtaining heat exchange between a pulverulent solid material and a gas. Such heat exchangers are used e.g. for preheating raw material to be subjected to a burning process, the preheating taking place by use of the hot exit gases from the burning process.

Preheating of pulverulent solid material can be carried out in a cyclone system which consists of cylones with the shape of an upright cylindrical vessel with a conical bottom ending in an outlet for the solid material, while the cylinder at its top is delimited by an annular top plate through the central part of which an outlet pipe for the gaseous medium extends into the cylinder. Solid material suspended in the gas is supplied via an inlet pipe opening tangentially into the cylinder. By the circulating movement of the gas in the cylindrical vessel the material is flung towards the vessel wall where it is stopped and slides down onto the conical bottom and out through the material outlet, while the gas leaves the heat exchanger through the central pipe at its top.

The most significant heat exchange between gas and material takes place already in a riser pipe where the suspended material is entrained by the gas. Consequently it is a co-current heat exchange. To obtain sufficient heat exchange between the two media it is necessary to use a plurality of these co-current heat exchangers in series, typically four or five stages for preheating cement raw meal before the burning process.

As it is known that an improved heat utilization is achieved when the heat exchanging media move counter-currently, i.e. that the material to be preheated constantly moves into an increasingly hotter gas, such a flow pattern is desirable.

From GB-A-988284 there is known a heat exchanger by which it is sought to make pulverulent material and gas move counter-currently to each other. This heat exchanger has the shape of a flat cylindrical vessel, mounted with the cylinder axis horizontal. The gas is introduced tangentially into the vessel, and follows a spiral path into the centre of the vessel at which point it is discharged through central pipes at the vessel end surfaces. The pulverulent material is introduced into the vessel along its axis and is given a velocity directed opposite to the gas being discharged in order to prevent the material from being entrained by the gas out of the heat exchanger. In another construction the material is introduced at a distance from the gas outlet which ensures that the gas vortex in the vessel causes a rotating movement of the material and flings it towards the vessel periphery. Precipitated material is discharged from the vessel through a material outlet at the lowest lying part of its periphery.

It is, however, evident that in the heat exchanger known from GB-A-988284, some entraining of the pulverulent material takes place and this requires a conventional separating heat exchanger to be mounted in the exit gas pipe in order to separate the entrained material which then is returned and introduced into the cylindrical vessel somewhere at a safe radial distance from its gas outlet. The farther from the vessel axis the material is introduced the shorter the distance available to it for flowing counter-currently to the hot gas.

Consequently, it is the object of the invention to devise a heat exchanger in which hot gas and pulverulent material move counter-currently and which provides improved separation so that a smaller part of the pulverulent material is entrained out through the gas outlet pipe.

According to the invention, this object is achieved by a heat exchanger comprising a cylindrical chamber having a horizontal axis, a tangential gas inlet at the periphery of the chamber, at least one gas outlet through an end of the chamber adjacent to its axis to produce, in use, a spiral gas flow from the gas inlet to the gas outlet, at least one material inlet for introducing material into the chamber adjacent to its axis, and a material discharge outlet for the discharge of material which has been flung centrifugally outwards through the spiral gas flow to the periphery of the chamber, characterised in that the or each material inlet is so arranged that at its introduction the material is given a tangential velocity component with respect to the axis of the chamber which is in the same sense about the axis as the spiral gas flow.

With this arrangement the material is, at its introduction given a tangential velocity component without being dependent on being accelerated by the gas, the velocity of which, adjacent to the axis of the chamber has a large axial component directed toward the gas outlet. The gas would otherwise tend to carry part of the material out through the gas outlet before giving the material a rotatary motion to fling the material centrifugally towards the periphery of the chamber.

The material is preferably introduced with a tangential velocity component which is substantially the same as that of the rotating gas at the point of introduction.

When the heat exchanger has only a gas outlet at one axial end of the chamber, the material may be introduced close to the other axial end. The angular velocity component given to the material at its introduction guarantees a rotatary movement of the material whereas the axial velocity of the gas near to the axis contributes to the distribution of the material across the whole axial width of the heat exchanger chamber.

In a heat exchanger having a gas outlet at both its axial ends the material, distribution across the chamber may be obtained in the same way by introducing the material in an area between the two axial ends of the heat exchanger substantially in the middle of the chamber.

Any desired material distribution profile across the axial width of the chamber may be obtained by providing a number of individual material inlets distributed across the axial width of the chamber.

The invention will now be explained in more detail, by reference to the accompanying drawings, in which.

Figure 1:
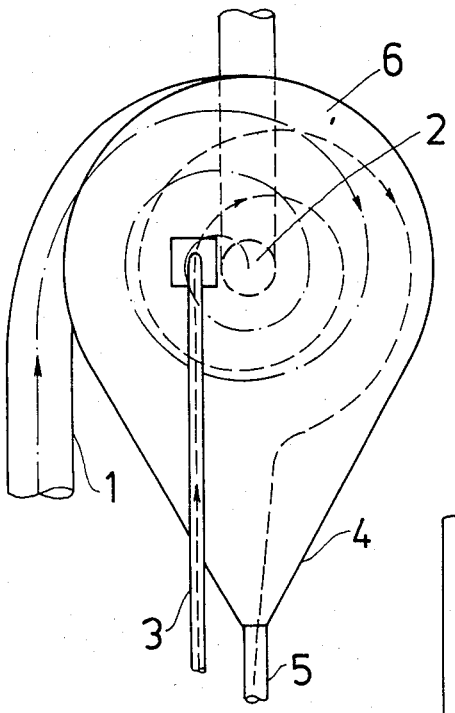
FIG. 1 is a diagrammatical front view of a heat exchanger according to the invention having a horizontal axis.
Figure 2:
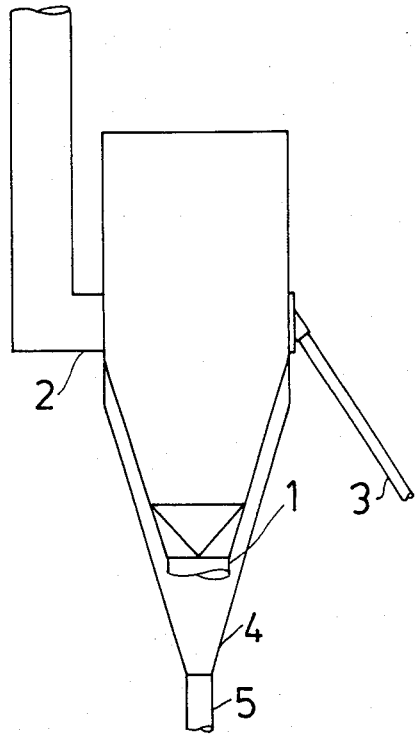
FIG. 2 is a side view of the heat exchanger shown in FIG. 1.

FIGS. 1 and 2 show schematically a heat exchanger comprising a cylindrical chamber 6 having a tangential gas inlet 1 and a central gas outlet 2 between which the gas moves along a spiral path as shown by the dash-dotted line. Pulverulent material to be preheated by the gas is introduced through a pipe 3 forming an acute angle with the front axial end of the heat exchanger through which end the pipe extends. Furthermore, the pipe is situated in a plane parallel with the horizontal axis of the heat exchanger. The material introduced, having a velocity directed towards the heat exchanger periphery, is deflected by the rotating gas so as to follow a spiral path as shown by the dotted line. The two spiral paths are thus in the same sense around the axis but one moves radially inwards while the other moves radially outwards.

It is evident that gas and material to some extent follow each other through the spiral turns. Countercurrent effects are achieved by the material being flung from one turn in the gas spiral to another, so that it comes into contact with increasingly hotter gas.

At its lowest lying part the cylindrical vessel extends into a material outlet hopper 4 which ends in an outlet 5 for separated pulverulent material.

In the example shown in FIGS. 1 and 2, wherein the material is introduced through the pipe 3, the introduced material is given a tangential velocity component with respect to the axis of the chamber which has the same direction as the sense of rotation of the gas. Through the sloping inlet pipe the material is further given an axial velocity promoting the distribution over the width of the heat exchanger.

This axial distribution is also promoted by the fact that the material inlet is mounted in the axial end of the cylindrical chamber opposite to the axial end with the gas outlet. This, the axial gas velocity component, which increases as the rotating gas approaches the axis, contributes to the distribution of the material across the axial width of the chamber. Correspondingly, the pulverulent material in a heat exchanger of the kind described with two gas outlets, one through each of its axial ends, may be introduced in the area between the two ends.

The introduction of material may be performed in a variety of ways, e.g. the material may be introduced as an axial jet which is spread by way of a scattering disc or a rotating scoop wheel. A scattering disc may be provided with guiding ribs giving the material the required tangential velocity component with respect to the axis and a scoop wheel may rotate in the same direction as the gas in the heat exchanger chamber.

Figure 3:
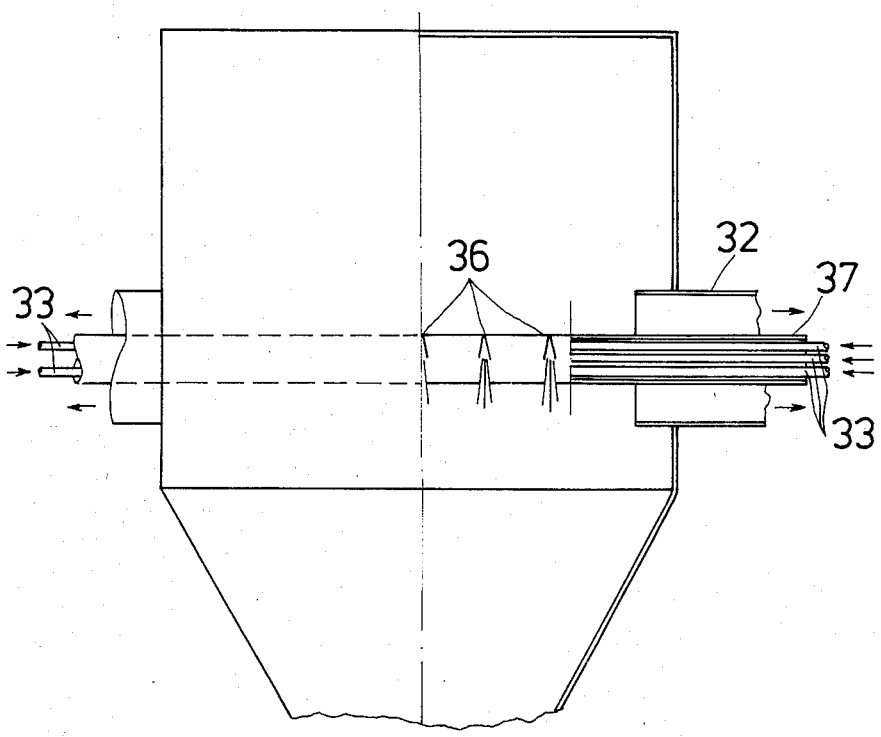
FIG. 3 is a partly sectional view of another heat exchanger according to the invention.

FIG. 3 shows an example of a heat exchanger in which the material is introduced through a number of individual inlets.

The material is led through a number of axial pipes 33 each connected to an individual material inlet nozzle 36 mounted on a central pipe 37 transversing the heat exchanger chamber concentrically to the gas outlet pipe or pipes 32 and enclosing the pipes 33.

With the above material inlet system it is possible to adapt the material introduction through the individual nozzles to the velocity profile of the gas over the width of the heat exchanger, e.g. by making the material velocity correspond to the gas velocity at the point of introduction at least as regards the tangential velocity components.

We claim:

1. In a heat exchanger comprising a cylindrical chamber having a horizontal axis, a tangential gas inlet at the periphery of said chamber, at least one gas outlet through an end of said chamber adjacent to the axis thereof whereby in use a spiral gas flow is produced from said gas inlet to said gas outlet, at least one material inlet for introducing material into said chamber adjacent to the axis thereof, and a material outlet for discharge of material which, in use, has been flung centrifugally outwards through said spiral gas flow to said periphery of said chamber, the improvement wherein said material inlet is separate from said gas inlet and is so arranged that material is introduced into said chamber therethrough having a tangential velocity component with respect to said chamber axis which is in the same sense about said axis as said spiral gas flow.

2. A heat exchanger according to claim 1, which has a single one of said gas outlets at one axial end thereof, and each said material inlet is located at the opposite axial end of said chamber.

3. A method of exchanging heat between a pulverulent material and a gas, comprising the steps of injecting said gas through a gas inlet tangentially at the periphery of a cylindrical chamber having a horizontal axis, causing said gas to flow in a spiral inwardly toward and out of at least one gas outlet through an end of said chamber adjacent to said axis, simultaneously injecting said pulverulent material into said chamber through at least one chamber inlet separate from said gas inlet and adjacent said axis such that said material so injected has a tangential velocity component with respect to said axis which is in the same sense about said axis as said spiral gas flow, and causing said material to flow in a spiral outwardly toward and out of a material outlet at the periphery of said chamber.

4. A method according to claim 3 wherein the tangential velocity component of the material as it is injected through said at least one inlet is substantially the same as the tangential velocity component of the spirally flowing gas at the point of material injection.

5. In a heat exchanger comprising a cylindrical chamber having a horizontal axis, a tangential gas inlet at the periphery of said chamber, at least one gas outlet through an end of said chamber adjacent to the axis thereof whereby in use a spiral gas flow is produced from said gas inlet to said gas outlet, at least one material inlet for introducing material into said chamber adjacent to the axis thereof, and a material outlet for discharge of material which, in use, has been flung centrifugally outwards through said spiral gas flow to said periphery of said chamber, the improvement wherein said at least one material inlet comprises a plurality of material inlets distributed across the axial width of said chamber, said inlets being so arranged that material is introduced into said chamber therethrough having a tangential velocity component with respect to said chamber axis which is in the same sense about said axis as said spiral gas flow.

6. In a heat exchanger comprising a cylindrical chamber having a horizontal axis, a tangential gas inlet at the periphery of said chamber, at least one outlet through an end of said chamber adjacent to the axis thereof whereby in use a spiral gas flow is produced from said gas inlet to said gas outlet, at least one material inlet for introducing material into said chamber adjacent to the axis thereof, and a material outlet for discharge of material which, in use, has been flung centrifugally outwards through said spiral gas flow to said periphery of said chamber, the improvement wherein said material inlet is so arranged that material is introduced into said chamber therethrough having a tangential velocity component with respect to said chamber axis which is in the same sense about said axis as said spiral gas flow and wherein said at least one gas outlet includes a gas outlet through each axial end of said chamber and said at least one material inlet is located between said gas outlets.

* * * * *